United States Patent [19]

Fujimoto

[11] Patent Number: 4,813,899

[45] Date of Patent: Mar. 21, 1989

[54] INFLATABLE POCKET LIFE PRESERVER

[76] Inventor: Haruo Fujimoto, 18174 Judy St., Castro Valley, Calif. 94546

[21] Appl. No.: 129,744

[22] Filed: Dec. 7, 1987

[51] Int. Cl.[4] ..... B63C 9/08

[52] U.S. Cl. ..... 441/122

[58] Field of Search ..... 441/88-128

[56] References Cited

U.S. PATENT DOCUMENTS 2,993,217 7/1961 Switlik ..... 441/94

3,152,344 10/1964 Radnofsicy et al. ..... 441/94

*Primary Examiner*—Joseph F. Peters, Jr.

*Assistant Examiner*—Jesus D. Sotelo

*Attorney, Agent, or Firm*—Linval B. Castle

[57] ABSTRACT

A life preserver used in pairs characterized by an inflatable air bag with an opening through the center for an arm to slip through. An arc-shaped inflator is attached to the top of the air bag. This also serves as a pull catch for extracting the folded pair of life preservers from pockets where they are stored. The air bag is preferably made from a strong, thin, airtight material. A belt, one end of which attaches inside the pocket where the folded air bag is stored, is attached to the bottom of the air bag, and remains attached after the air bag is extracted, inflated and put to use.

6 Claims, 2 Drawing Sheets

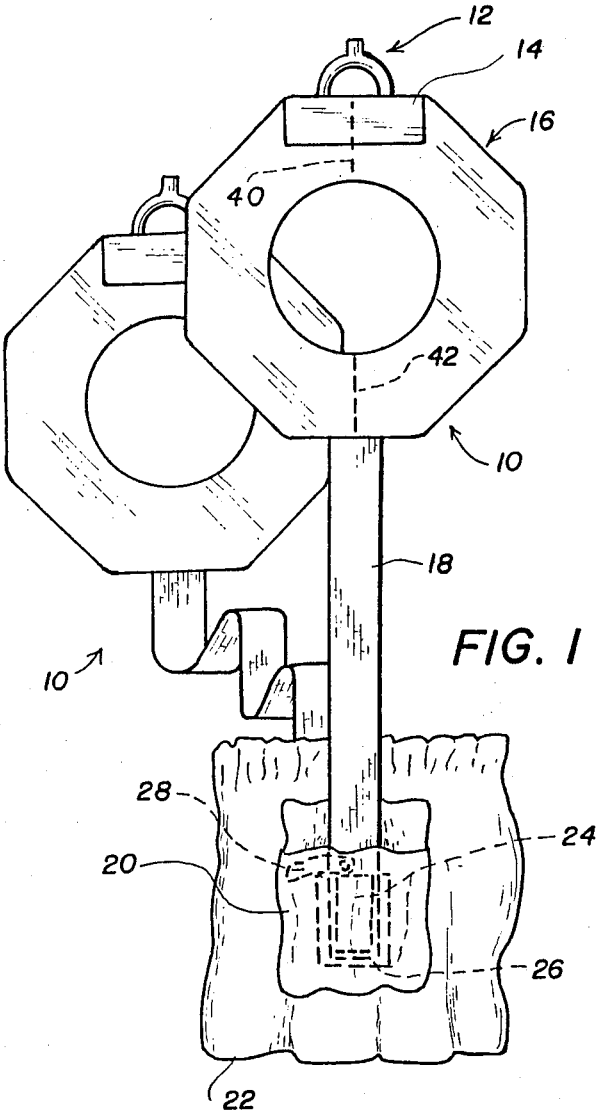
FIG. 1
FIG. 2
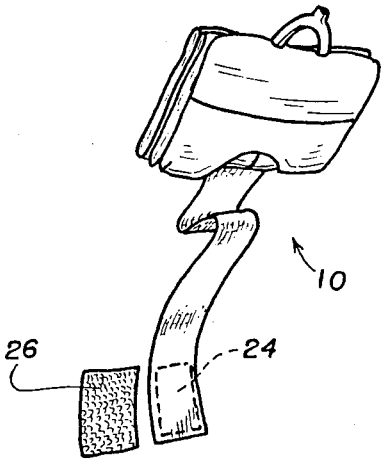
FIG. 3
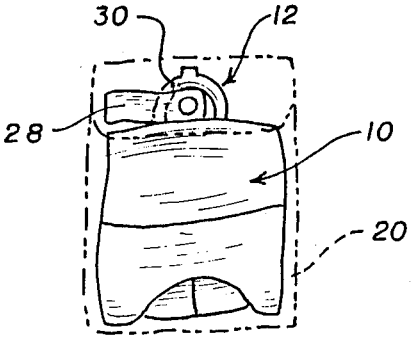
FIG. 4
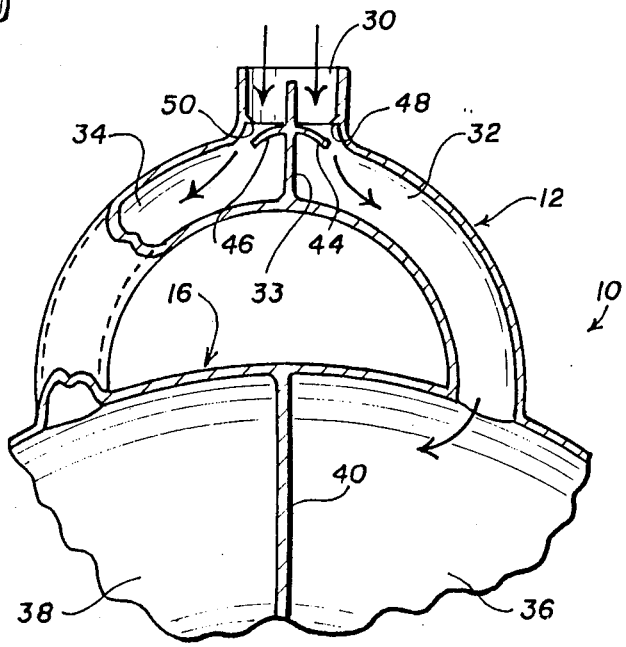

FIG. 5
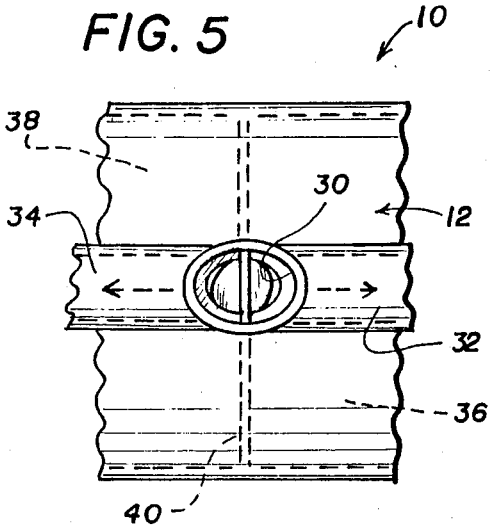
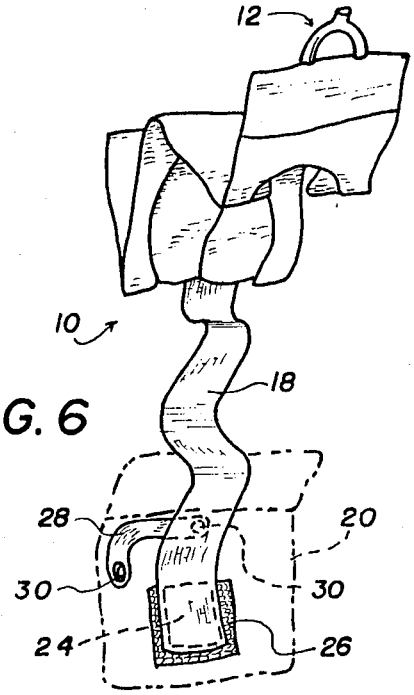
FIG. 6
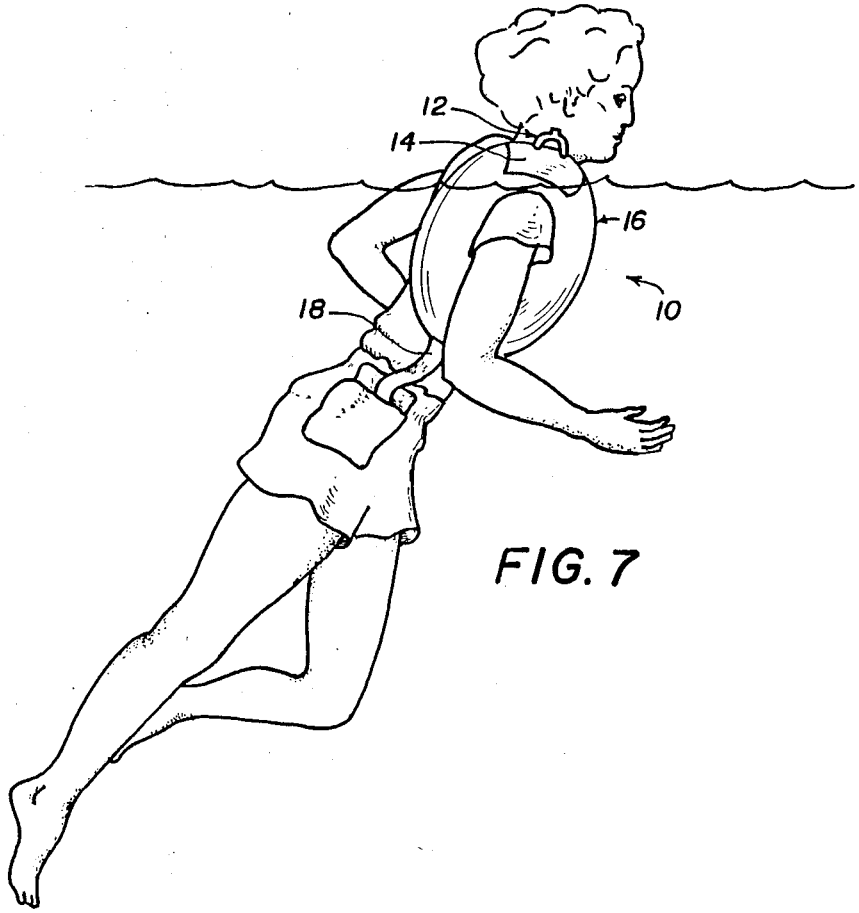
FIG. 7

INFLATABLE POCKET LIFE PRESERVER

BRIEF SUMMARY OF THE INVENTION

This invention is a novel inflatable emergency flotation life preserver which stores out of sight until needed. Preferably two are used, each contained in its own pocket. When needed they are removed from the pockets, inflated, and slipped on, one on each arm. They float the user until rescue comes.

Life preservers typically used in water-related activity are often stored on boats, yachts, barges etc., instead of being worn by those who need them in an emergency. Life preservers tend to be bulky and uncomfortable to wear for extended periods of time. A purpose of the invention is to provide life preservers that are immediately available for use should the need arise. Another purpose is to provide a life preserver that is comfortable to wear, as a result of being deflated and stored in the pockets of clothing.

An addition purpose is to provide an extra margin of safety by having multiple air chambers in the life preserver. Inflation is accomplished through a novel inflator which also serves as a catch for removing the life preservers from the pockets.

BRIEF DESCRIPTION OF THE DRAWINGS

In the drawings which illustrate the preferred embodiment of the invention:

FIG. 1 is an elevational view showing a pair of life preservers connected to the pockets of a pair of shorts.

FIG. 2 is a perspective view of a folded life preserver with its belt.

FIG. 3 is an elevational view showing a folded life preserver in a pocket.

FIG. 4 is a sectional view showing the inflator, the component flapper valves and a partial section through the chambers of the air bag.

FIG. 5 is a top view of the inflator.

FIG. 6 is a perspective view of an unfolding life preserver extending from a pocket.

FIG. 7 is a perspective view showing a pair of life preservers in use.

DETAILED DESCRIPTION

Referring to FIG. 1, life preservers in accordance with the present invention are preferably used as a pair. They are constructed of a very thin yet durable airtight material, such as a coated nylon or polyester, and are shaped octagonally. The thin materials and the octagonal shape make it possible to fold the life preserver into a small configuration for storing in pockets.

As mentioned above life preservers 10 are used in pairs; however, for the purposes of discussion a single unit will be described as the members of the pair are identical. Life preserver 10 is comprised of an inflator 12, a reflective patch 14, an air bag 16, a belt 18 and a removable fastener 24, such as Velcro. It also has two components that attach inside a pocket 20: a mating removable fastener 26 and a strap 28.

The inflator 12 is located at the top of the life preserver. The patch of reflective material 14 is affixed to the top of the inflatable air bag 16. This portion of the bag will normally be above the water when the life preserver is in use. This gives the wearer high visibility, especially at night. One end of the belt 18 is secured to the bottom of the air bag. The other end is secured inside a pocket 20 of a pair of shorts 22 as shown. However, it can easily be seen that pockets in other clothing could be used and such pockets could be located on the side, front or back of the clothes. The end of the belt 18 has the removable fastener 24 attached. This secures to the mating fastener 26 attached inside the pocket. These pads are shown separately in FIG. 2 which also shows the air bag 16 folded. Having the belt easily removable from the pocket by removable fasteners allows the clothes to be laundered or the life preserver to be replaced.

Referring now to FIG. 3, life preserver 10 is folded and contained in the pocket 20. The arc-shaped inflator 12 is held into place by a strap 28 that is attached at one end inside the pocket. Each end of the strap is secured by a mating snap 30. Although snaps are mentioned, other force release devices or Velcro could be used. When the snaps are secured to each other, the strap 28 captures the inflator 12, holding it in place where it can be easily reached. The inflator is then released by a finger pull and pulled from the pocket along with the entire life preserver unit.

Referring now to FIG. 4, a section through the arc-shaped inflator 12 and the air bag 16 is shown. When air is blown into the mouthpiece opening 30 by the user, if flows through flapper valves 44 and 46 and into independent air conduits 32 and 34 partitioned off by diaphragm 33 of inflator 12, and from there into independent air chambers 36 and 38 respectively. These air chambers of the air bag 16 are separated by an airtight diaphragm 40 on the inside of the upper portion of the air bag and by an airtight diaphragm 42 at the lower portion of the substantially torus-shaped air bag. Both diaphragms are shown by dashed lines in FIG. 1. The resilient flapper valves 44 and 46 are forced open by the flow of entering air; when the flow ceases they close against the valve seats 48 and 50 respectively. The air chambers' pressure and the natural resiliency of the flapper valves encourage the closing of the valves which stops air from exiting the air bag. Evacuation can be accomplished by squeezing the outside of the flexible inflator 12 while compressing the air bag 16. This operation distorts the flapper valves 44 and 46 allowing the air to escape. Referring now to the pair of independent chambers 36 and 38, it can easily be seen that the air bag could be constructed with a single air chamber or with more air chambers and component valves than is shown; such modifications are meant to be within the scope of the invention.

The operation is as follows: When the need to use the life preserver presents itself, either in or out of water, the user reaches into the pockets with his or her fingers, engages the arc-shaped inflator 12 also serving as a handle, and pulls, causing the snaps 30 of the strap 28 to release. The two life preservers 10 are then pulled from the pockets and unfold simultaneously. One unfolding life preserver is illustrated in FIG. 6. The user then inflates both air bags 16 by blowing into their inflators 12. The life preservers can be slipped over each arm either before or after inflation, depending on the situation or convenience of the user. After this short extraction, inflation and placement procedure the life preservers are ready for use.

What is claimed is:

1. An inflatable emergency life preserver for folded storage within a clothing pocket, said life preserver including:

a substantially torus-shaped air bag having a central opening fitting around the arm and shoulder of a wearer;

an inflator being connected to an exterior surface of said air bag having one-way valving means for inflating said air bag, said inflator including:

a substantially arc-shaped configuration serving as a handle for extraction from folded storage.

2. The life preserver as recited in claim 1 wherein said air bag is formed of at least two separated air chambers and wherein said means for inflating includes a one-way valved air conduit into each of said chambers.

3. The life preserver as recited in claim 1 further including a belt connected at a first end to said air bag, the second end of said belt removably secured to a fastener within the clothing pocket.

4. A life preserver as recited in claim 1 further including reflective material affixed to the top exterior surface of said air bag.

5. A life preserver as recited in claim 1 further including a means for removably securing said life preserver in folded storage within said clothing pocket including:

a strap extending through said arc-shaped handle having a first end secured to the inside of said clothing pocket, the second end of said strap removably secured to a fastener attached to the inside of said clothing pocket.

6. An inflatable emergency life preserver for folded storage within a clothing pocket, said lift preserver including:

a substantially torus-shaped air bag formed of at least two separated air chambers and having a central opening for encircling the arm and shoulder of a wearer;

means including a one-way valved air conduit into each of said chambers for inflating said air bag; and a belt connected at a first end to said air bag, the second end of said belt removably secured to a fastener within the clothing pocket.

* * * * *